US007318883B2

(12) United States Patent
Rahkomaa et al.

(10) Patent No.: US 7,318,883 B2
(45) Date of Patent: Jan. 15, 2008

(54) EQUIPMENT AND METHOD IN A PAPER OR BOARD MACHINE FOR MIXING OF FRESH STOCK AND OF WATER FOR DILUTION OF FRESH STOCK

(75) Inventors: Jouni Rahkomaa, Tampere (FI); Sakari Soini, Somero (FI)

(73) Assignee: Metso Paper, Inc., Helsinki (FI)

( * ) Notice: Subject to any disclaimer, the term of this patent is extended or adjusted under 35 U.S.C. 154(b) by 1817 days.

(21) Appl. No.: 09/719,029

(22) Filed: Dec. 5, 2000

(65) Prior Publication Data

US 2006/0096730 A1 May 11, 2006

Related U.S. Application Data

(63) Continuation of application No. PCT/FI99/00458, filed on May 27, 1999, now abandoned.

(30) Foreign Application Priority Data

Jun. 5, 1998 (FI) ..... 981286

(51) Int. Cl.
*D21F 1/06* (2006.01)
*D21F 1/66* (2006.01)

(52) U.S. Cl. ..... 162/380; 162/190; 162/216; 162/264; 366/338

(58) Field of Classification Search ..... 162/189, 162/190, 212, 216, 254, 258, 259, 264, 336, 162/337, 343, 380; 366/336–341
See application file for complete search history.

(56) References Cited

U.S. PATENT DOCUMENTS

| | | | | |
|---|---|---|---|---|
| 3,812,007 | A * | 5/1974 | Kaiser | 162/343 |
| 3,839,145 | A | 10/1974 | Bueckle | 162/190 |
| 4,021,296 | A | 5/1977 | Reiner | 162/214 |
| 4,808,007 | A * | 2/1989 | King | 366/337 |
| 4,929,088 | A * | 5/1990 | Smith | 366/337 |
| 5,030,326 | A | 7/1991 | Nous | 162/258 |
| 5,839,828 | A * | 11/1998 | Glanville | 366/340 |
| 6,200,417 | B1 * | 3/2001 | Binder et al. | 162/57 |
| 6,277,243 | B1 * | 8/2001 | Binder et al. | 162/189 |
| 6,368,462 | B1 * | 4/2002 | Lumiala et al. | 162/258 |
| 6,740,198 | B2 * | 5/2004 | Ahola et al. | 162/57 |
| 6,986,832 | B2 * | 1/2006 | Lamminen et al. | 162/381 |

FOREIGN PATENT DOCUMENTS

| | | | |
|---|---|---|---|
| FI | 100168 | * | 4/1968 |
| FI | 100168 | | 10/1969 |
| FI | 56221 | | 8/1979 |

* cited by examiner

*Primary Examiner*—Eric Hug
(74) *Attorney, Agent, or Firm*—Wolf Block Schorr & Solis-Cohen LLP

(57) ABSTRACT

The invention concerns an equipment and a method in a paper or board machine for mixing fresh stock (M) with water (V) used for dilution of the fresh stock. At the point of mixing (K) of the dilution water (V) and the fresh stock (M) passed from the pipe (13), there is at least one such pipe portion as comprises a wave-shaped form in its connection in the cross section of the pipe.

20 Claims, 3 Drawing Sheets

EQUIPMENT AND METHOD IN A PAPER OR BOARD MACHINE FOR MIXING OF FRESH STOCK AND OF WATER FOR DILUTION OF FRESH STOCK

This is a continuation of international application PCT/FI99/00458, filed May 27 1999 (which designated the U.S.), now abandoned, and which claimed priority of Finnish Patent Application FI 981286, filed Jun. 5, 1998.

FIELD OF THE INVENTION

The invention concerns an equipment and a method in a paper or board machine for mixing fresh stock used for manufacture of paper or board with water used for dilution of the fresh stock.

BACKGROUND OF THE INVENTION

From the prior art, a solution of equipment is known in which fresh stock and a return circulation are passed into a narrowing duct after the wire pit in a paper or board machine. An essential feature of the system is good mixing of fresh stock, white water, and the return circulation.

OBJECTS AND SUMMARY OF THE INVENTION

In an attempt to obtain good mixing of the white water of the short circulation and of fresh stock in a paper/board machine, in the present patent application it is suggested that, in the area in the duct after the wire pit in which the fresh stock is introduced, at least one duct comprises, on its face, a duct form that is wave-shaped in a cross-section perpendicular to the longitudinal axis of the flow duct. Said wave-shaped duct form produces secondary vortexes in the flow, which vortexes result in efficient mixing of the flows.

The equipment in accordance with the present invention is characterized in that, at the point of mixing of the dilution water and the fresh stock passed from the pipe, there is at least one such pipe portion as comprises a wave-shaped form in its connection in the cross-section of the pipe.

The method in accordance with the invention is characterized in that, at the point of mixing of the water used for dilution of fresh stock and the fresh stock passed from the pipe, secondary vortexes are formed, which are formed by means of a wave-shaped face form of the pipe.

BRIEF DESCRIPTION OF THE DRAWINGS

The invention will be described in the following with reference to some preferred embodiments of the invention illustrated in the figures in the accompanying drawings, the invention being, yet, not supposed to be confined to said embodiments alone.

DETAILED DESCRIPTION OF THE INVENTION.

Figure 1B:
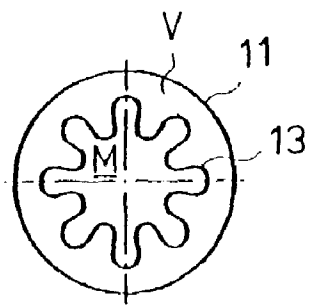
FIG. 1B is a sectional view taken along the line IV-IV in FIG. 1A on an enlarged scale.
Figure 1A:
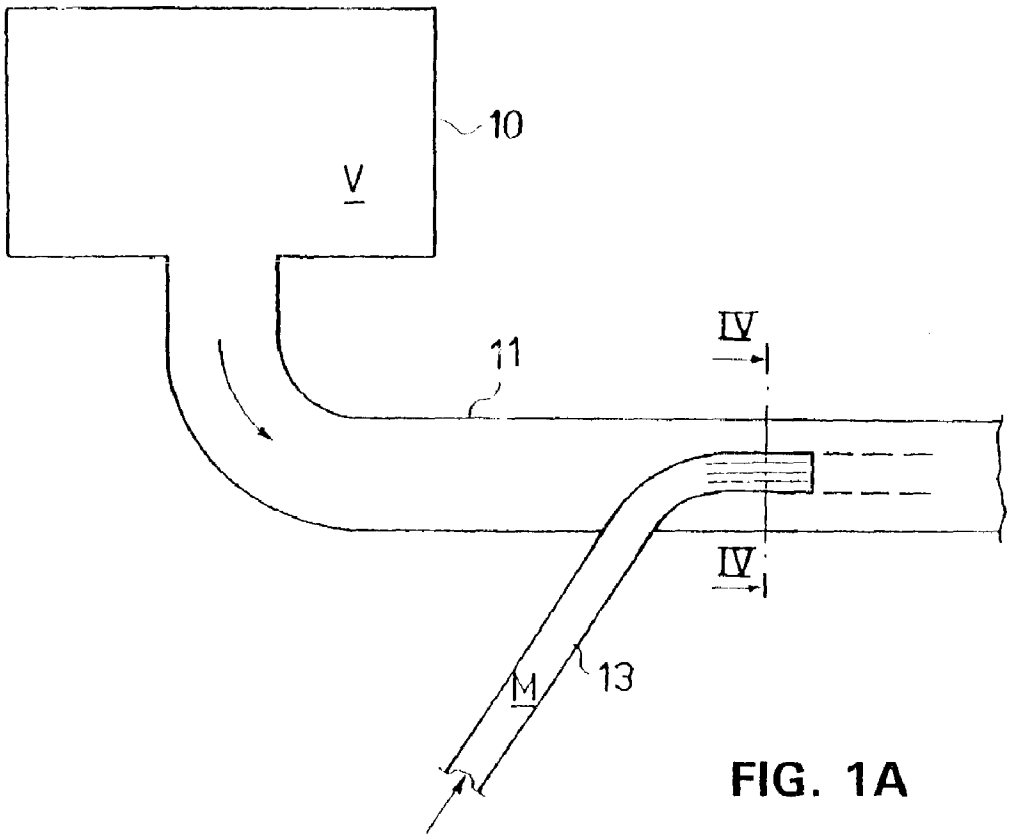
FIG. 1A illustrates a common embodiment of the invention, in which a water in general, which has been meant for dilution of stock, and a high-consistency stock are mixed while making use of a wave-shaped pipe form.

FIG. 1A illustrates the commonest embodiment of the invention, in which the water V used for dilution of fresh stock M is passed through the pipe 11, and the high-consistency fresh stock M is passed through the pipe 13. At the end of the pipe 13 and after said end, the high-consistency stock M and the water V used for dilution of the stock are mixed with each other owing to the wave formation in accordance with the invention at the end of the pipe 13. In the embodiment shown in FIG. 1A, the wave form extends both to the interior of the pipe 13 and to the outer face of the pipe 13, in which case the mixing of the water V used for dilution of the fresh stock M with the fresh stock M is efficient. The water passed along the pipe 11 and used for dilution of the stock is favourably white water, which is passed, in the way shown in FIG. 1A, from a wire pit tank 100. As is shown in the figure, the wire pit tank 10 is a deaeration tank of the short circulation in a paper or board machine, into which tank the white water V is passed from a separate intermediate tank. Thus, in the commonest embodiment of the invention, by means of the wave-shaped pipe construction 13, in general, the high-consistency fresh stock M and the water V that dilutes said stock are mixed with each other efficiently, and the dilution water favourably consists of the white water of the short circulation in the paper/board machine.

FIG. 1B is a sectional view taken along the line IV-IV in FIG. 1A. As is shown in the figure, the line of supply of the high-consistency stock, preferably a pipe 13, is provided with a wave formation at its end. The waves extend both inside and outside of the circumference the pipe 13, in which case they act both upon the fresh stock M flowing in the pipe 13 and upon the stock dilution water V, favourably white water, flowing outside the pipe 13.

Figure 1C:
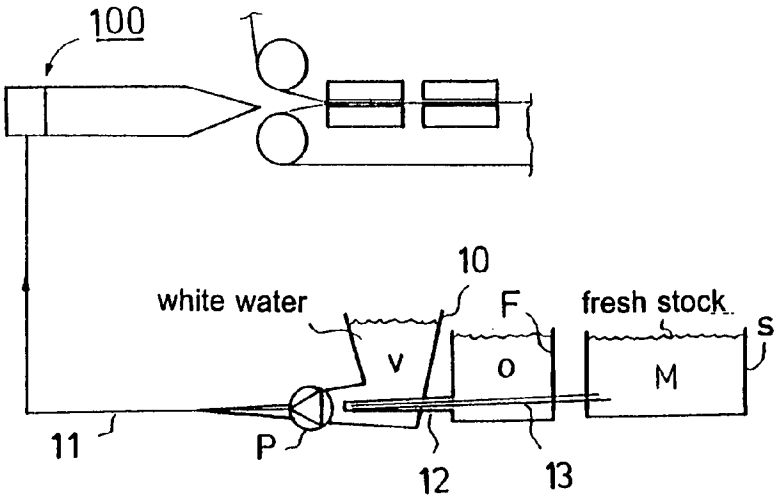
FIG. 1C is an illustration of principle of the short circulation in a paper/board machine, in which white water that has been recovered as retention is passed into the wire pit, white water being passed from the bottom of the wire pit as a return circulation into the headbox.

FIG. 1C is an illustration of principle of the use of the white-water pit of the short circulation in a paper or board machine in collecting of retention waters and in recycling of fibrous white water, in which connection the fresh stock M and the water O of the return circulation are passed into connection with the white water V and in which construction, further, the combined mixed flow is passed from the wire pit 10 into connection with the headbox 100 of the paper or board machine. As is shown in FIG. 1C, the white waters are passed from the wire into the wire pit 10 and into the duct 11 placed at the bottom of the wire pit 10 In addition to the white water V from the wire pit 10, the water O of the return circulation from the tank F and the fresh stock M from the stock tank S are also passed. By means of a pump P, the combined flow $L_1+L_2+L_3$ (as seen in FIG. 1D) is passed further into the headbox 100.

At the bottom of the wire pit, in accordance with the invention, the white water is mixed with the fresh stock and with the water of the return circulation, which water is, for example, a bypass flow circulation from the headbox or an accept from the second stage of vortex cleaning. The sequence of consistencies is as follows. The highest consistency is that of the high-consistency stock. The next consistency is that of the water from the return circulation, and the lowest consistency is that of the white water (white water<return circulation<high-consistency stock).

Figure 1D:
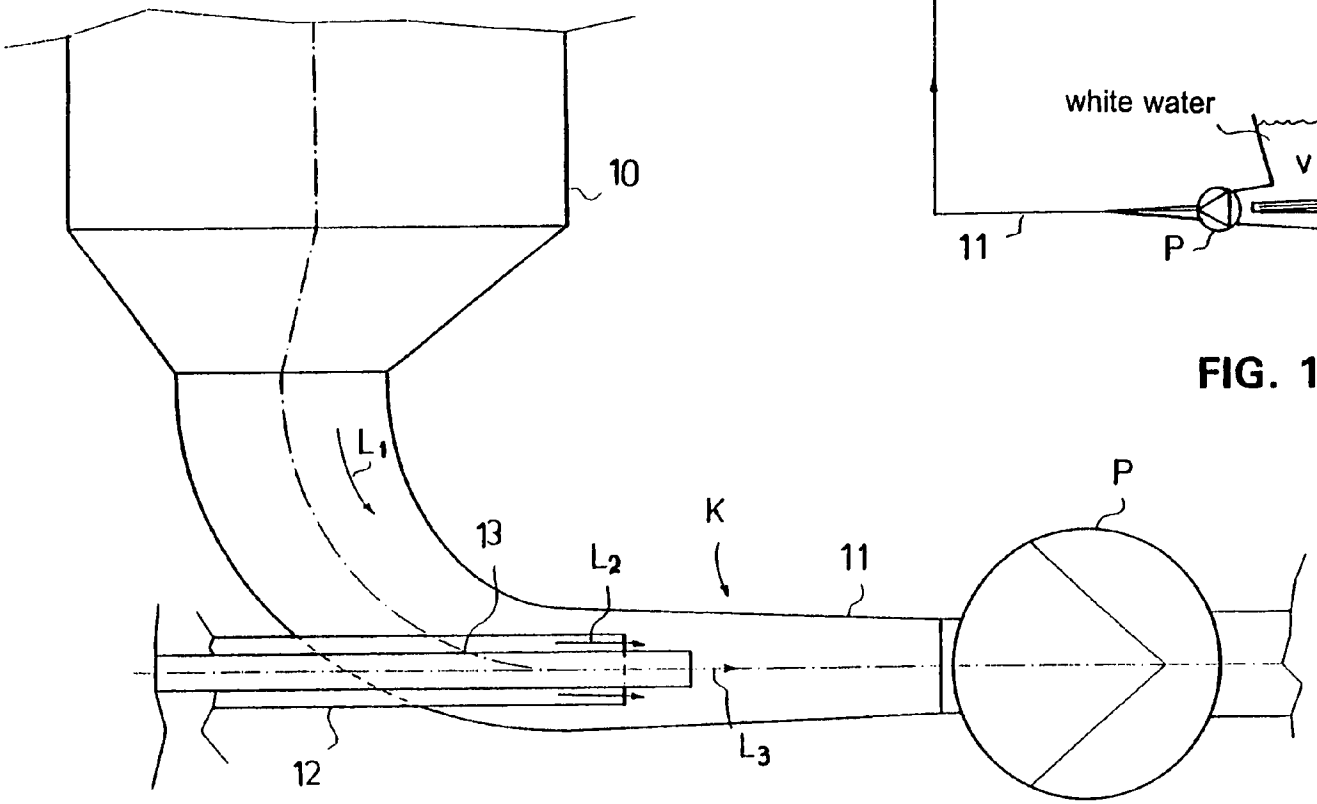
FIG. 1D is an illustration on a larger scale of an arrangement of equipment in accordance with the invention in which feed pipes of stock and of the return circulation are passed into connection with the white water passed from the bottom portion of the wire pit.

FIG. 1D shows an equipment in accordance with the invention, in which, in the way indicated by the arrow $L_1$, the fibrous water is passed from the white-water pit 10 back to circulation into the pipe 11. Into the pipe 11, also fresh stock M is passed from the pipe 13, and the water O of the return circulation is passed from the pipe 12. The pipe 12 has been passed into the interior of the pipe 11 in an area in which the pipe 11 is curved and its cross-sectional flow area becomes narrower. Through the pipe 12, the return circulation, i.e. the water O of the return circulation, is passed (arrow $L_2$) into connection with the white water V. Centrally in the interior of the pipe 12, there is the pipe 13. The pipe 13 has been passed coaxially in the interior of the pipe 12. Through the pipe 13 (arrow $L_3$) the fresh stock M is passed into connection with the water O of the return circulation and with the white water V passed from the wire pit 10. Thus, in the narrowing flow passage in the pipe 11, in the area K, the stock M, the return circulation water O, and the white water V are mixed. As is shown in the figure, the pump P produces suction in the pipe 11, and by means of the pump P the combined flow $L_1+L_2+L_3$ of the components V, M, O is passed further into connection with the headbox 100 of the paper/board machine.

In order that the mixing of the stock M and of the return circulation water O and of the white water V should be as efficient and complete as possible, in the area K of mixing of the flows $L_1$, $L_2$ and $L_3$, at least one of the pipes 11, 12 or 13 is provided with a wave-shaped face form in a cross-section perpendicular to the longitudinal axis of the flow duct. Said wave-shaped face form produces what is called secondary vortexes, which promote the mixing together of the flows $L_1$, $L_2$ and $L_3$.

Figure 2A:
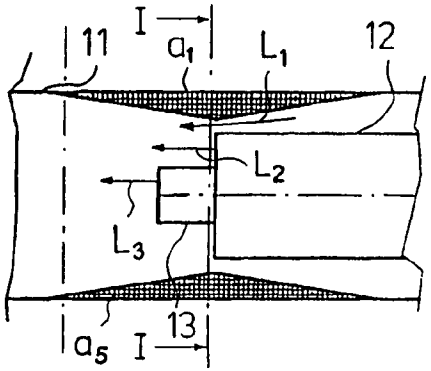
FIG. 2A shows a first embodiment of the invention, in which the wave-shaped form has been formed onto the inner wall of the pipe 11 connected with the wire pit.
Figure 2B:
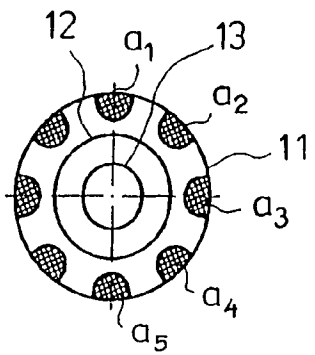
FIG. 2B is a sectional view taken along the line I-I in FIG. 2A.

FIG. 2A is a longitudinal sectional view of the mixing area K and of a first preferred embodiment of the invention. FIG. 2B is a sectional view taken along the line I-I in FIG. 2A. FIGS. 2A and 2B show an embodiment in which the pipe 11 has been provided with form pieces $a_1,a_2,a_3 \ldots$, whose outer circumference becomes narrower in wedge shape, which have been fitted on the inner face of the pipe 11, and which have been further shaped so that, as shown in the cross-sectional view, the maximal height of the wedge part $a_1,a_2,a_3 \ldots$ that produces the wave shape, in the middle of the wedge part $a_1$, $a_2 \ldots$, is placed in the area of the end of the pipe 12 that passes the water O of the return circulation. The pipe 13 that passes the stock M projects further from the interior of the pipe 12.

Figure 3A:
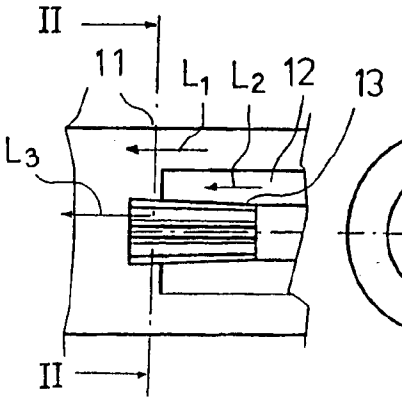
FIG. 3A shows a second embodiment of the invention, in which the wave shape has been formed onto a pipe 13 passed in the interior of the pipe 12.
Figure 3B:
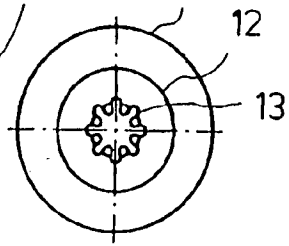
FIG. 3B is a sectional view taken along the line II-II in FIG. 3A.

FIG. 3A is a longitudinal sectional view of a second embodiment of the invention. FIG. 3B is a sectional view taken along the line II-II in FIG. 3A.

In the embodiment shown in FIGS. 3A and 3B, the wave shape has been formed onto the central pipe 13 fitted inside the pipe 12. The pipe 13 projects from the pipe 12. Thus, secondary vortexes are produced both in the flow $L_2$ of the return circulation water O inside the pipe 12 and in the flow $L_3$ of fresh stock M inside the pipe 13. Thus, by means of the wave-shaped face of the pipe 13, an effect that produces secondary vortexes is applied both to the return circulation water O flowing in the pipe 12 and to the stock M that flows in the pipe 13.

Figure 4A:
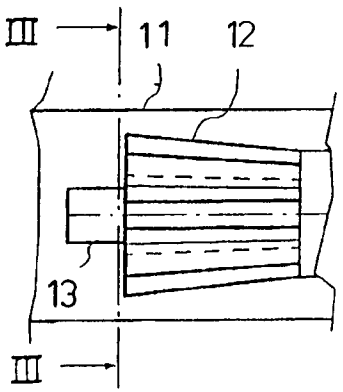
FIG. 4A shows an embodiment of the invention, in which the wave-shaped form has been formed onto the pipe 12.
Figure 4B:
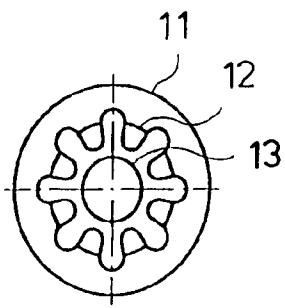
FIG. 4B is a sectional view taken along the line III-III in FIG. 4A.

FIG. 4A is a longitudinal sectional view of a third preferred embodiment of the invention. FIG. 4B is a sectional view taken along the line III-III in FIG. 4A.

FIGS. 4A and 4B show an embodiment of the invention in which the wave shape has been formed onto the flow pipe 12 so that the wave shape acts upon the flow $L_1$ of white water V in the pipe 11 and upon the flow $L_2$ of the return circulation water O in the pipe 12.

In the following, the patent claims will be given, and the various details of the invention can show variation within the scope of the inventive idea defined in the claims and differ even to a considerable extent from the (letails stated above by way of example only. As such, the examples provided above are not meant to be exclusive and many other variations of the present invention would be obvious to those skilled in the art, and are contemplated to be within the scope of the appended claims.

The invention claimed is:

1. An equipment in a paper or board machine for mixing fresh stock (M) with water (V) used for dilution of the fresh stock, comprising:

at a point of mixing (K) of the dilution water (V), passed from a dilution water pipe (11), and the fresh stock (M), passed from a fresh stock pipe (13), there is at least one pipe portion having a wave-shaped form in a cross-section perpendicular to the longitudinal axis of said at least one pipe portion.

2. An equipment as claimed in claim 1, wherein the dilution water (V) consists of white water.

3. An equipment as claimed in claim 1, wherein the equipment further comprises a pipe (12) for passing a return circulation water (0) to the mixing point (K) of fresh stock (M) and white water (V), and that the pipe (13), through which the stock (M) is passed, has been passed coaxially in the interior of the pipe (12).

4. An equipment as claimed in claim 1, wherein the dilution water pipe (11) further comprises:

a wave-shaped form on a wall face thereof.

5. An equipment as claimed in claim 4, wherein the wave shape on an inner face of the pipe (11) has been produced by means of form pieces ($a_1$, $a_2$, $a_3 \ldots$), which form pieces are of curved cross-section and which have been fitted at a distance from one another on the circumferential measure of the pipe (11) on the inner face of the pipe (11).

6. An equipment as claimed in claim 3, wherein the pipe (13), which is placed in the interior of the pipe (12), is provided with a wave-shaped face form, in which case the return circulation water (0) that is passed in the pipe (120 is confined by the wave-shaped outer shape of the pipe (13), and the stock (M) that is passed in the pipe (13) is confined by the wave-shaped inner shape of the pipe (13).

7. An equipment as claimed in claim 3, wherein the pipe (12), through which the return circulation water (0) is introduced in the pipe (11), is provided with a wave shape, whose form is provided both on the inner face and on the outer face of the pipe, in which connection both the white water (V) flowing in the pipe (11) and the return circulation water (0) passed in the pipe (12) are confined by said wave shape.

8. An equipment as claimed in claim 7, wherein the pipe (12) and the pipe (13) have been passed through a curved portion of pipe (11) placed below the white-water pit (10) 50 that the pipes (12 and 13) have been passed through the wall of the pipe (11), and that the pipe (13) projects from the end of the pipe (12), and that the pipe (13) is placed centrally inside the pipe (12).

9. An equipment as claimed in claim 1, wherein the white water pipe (11) further comprises:

a pump (P) placed after the mixing point (K) of the white water, fresh stock, and a circulation water in view of passing said materials into a headbox (100) of the paper/board machine.

10. An equipment as claimed in claim 1, wherein the pipe (11) has a flow (L1+L2+L3), and wherein said pipe (11) becomes narrower in a flow direction of the flow ($L_1$+$L_2$+$L_3$).

11. An equipment as claimed in the claim 2, wherein the white water (V) that is used as the dilution water is passed from a deaeration tank (100) of the short circulation in the paper/board machine.

12. A method in a paper or board machine for mixing fresh stock (M) with water (V) used for dilution of the fresh stock, comprising the step of:

forming secondary vortexes at a point of mixing (K) of the dilution water (V), passed from a dilution water pipe (11) having a flow (L1, L2), and the fresh stock (M), passed from a fresh stock pipe (13) having a flow (L3), said vortexes being formed in at least one of said flows L1 L2 L3 by means of at least one of said pipes having at least an end portion with a wave-shaped cross-section.

13. A method as claimed in claim 12, wherein white water is used as the dilution water (V).

14. A method as claimed in claim 13, wherein the white water is passed from a deaeration tank (100) of a short circulation of the white water in the paper/board machine.

15. An equipment for the improved mixing and diluting of a fresh stock (M) with a white water (V) in a paper or board machine, comprising:

a white water pipe (11) for conducting said white water (V);

a fresh stock pipe (13) structured and arranged to feed said fresh stock (M) coaxially into said white water pipe (11) at a mixing point; and at least one of said white water pipe (11) and said fresh stock pipe (13) having at least a portion which has a transverse cross-section that is wave-shaped, said portion being located at said mixing point between said fresh stock (M) and said white water (V), whereby said wave-shape produces secondary vortexes in said flow of fresh stock and flow of white water in order to enhance the mixing and diluting of said fresh stock flow with said white water flow.

16. The equipment according to claim 15, further comprising:

a return circulation water pipe (12) is structured and arranged to coaxially conduct a return circulation water (0), through said white water pipe (11), to said mixing point between said fresh stock (M) and said white water (V); and wherein said fresh stock pipe (13) is structured and arranged to coaxially conduct said fresh stock (M) into said return circulation water pipe (12), to said mixing point between said fresh stock (M) and said white water (V).

17. The equipment according to claim 15, wherein said wave-shape is formed on an inner surface of said white water pipe, wherein said wave-shape comprises a plurality of spaced form pieces extending radially inward from said inner surface of said white water pipe.

18. The equipment according to claim 17, wherein said form pieces have a curved cross section.

19. The equipment according to claim 16, wherein said fresh stock pipe (13), structured and arranged coaxially within said return circulation water pipe (12), is provided with said wave-shape formed along an inner circumferential surface and an outer circumferential surface thereof whereby said return circulation water (0), conducted through said return circulation water pipe (12), is conducted over said wave-shape formed along said outer circumferential surface of said fresh stock pipe (13) and whereby said fresh stock (M), conducted through said fresh stock pipe (13), is conducted over said wave-shape formed along said inner circumferential surface of said fresh stock pipe (13), thereby producing secondary vortexes in said return circulation water (0) and said fresh stock (M).

20. The equipment according to claim 16, wherein said return circulation pipe (12), structured and arranged coaxially within said white water pipe (11), is provided with said wave-shape formed along an inner circumferential surface and an outer circumferential surface thereof, whereby said return circulation water (0), conducted through said return circulation water pipe (12), is conducted over said wave-shape formed along said inner circumferential surface of said return circulation pipe (12) and whereby said white water (V), conducted through said white water pipe (11), is conducted over said wave-shape formed along said outer circumferential surface of said return circulation pipe (12), thereby producing secondary vortexes in said return circulation water (0) and said white water (V).

* * * * *